United States Patent [19]

Seki

[11] Patent Number: 4,560,326

[45] Date of Patent: Dec. 24, 1985

[54] DIAPHRAGM TYPE PUMP DEVICE

[75] Inventor: Kimiaki Seki, Kasai, Japan

[73] Assignee: Mitsubishi Denki Kabushiki Kaisha, Tokyo, Japan

[21] Appl. No.: 662,158

[22] Filed: Oct. 18, 1984

[30] Foreign Application Priority Data

Oct. 28, 1983 [JP] Japan ..... 58-167708[U]

[51] Int. Cl.[4] ..... F04B 43/00

[52] U.S. Cl. ..... 417/480; 92/99; 92/102; 417/274

[58] Field of Search ..... 92/84, 85 A, 103 SD, 92/99, 103, 60.5; 417/470, 471, 480, 274

[56] References Cited

U.S. PATENT DOCUMENTS

| | | | |
|---|---|---|---|
| 1,327,272 | 1/1920 | Dellgren | 92/84 |
| 1,946,590 | 2/1934 | Rockwell | 417/471 |
| 2,712,793 | 7/1955 | Holm | 92/84 |
| 2,895,424 | 7/1959 | Tramontini | 92/84 |
| 2,998,288 | 8/1961 | Newhouse | 92/85 A |
| 3,039,399 | 6/1962 | Everett | 92/103 SD |
| 3,186,343 | 6/1965 | Schneider | 92/84 |
| 3,314,365 | 4/1967 | Ritchie | 417/480 |
| 3,354,831 | 11/1967 | Acker et al. | 92/103 SD |
| 3,969,045 | 7/1976 | Sakai et al. | 417/471 |
| 3,999,899 | 12/1976 | Sakai | 417/471 |

FOREIGN PATENT DOCUMENTS

| | | | |
|---|---|---|---|
| 2128987 | 1/1973 | Fed. Rep. of Germany | 92/85 A |
| 5037530 | 6/1971 | Japan | 92/102 |

*Primary Examiner*—William L. Freeh

*Attorney, Agent, or Firm*—Oblon, Fisher, Spivak, McClelland & Maier

[57] ABSTRACT

A diaphragm type pump device comprising a casing having a cover in which an inlet valve is installed, a diaphragm dividing the interior of the casing into a suction chamber and a discharge chamber, a movable plate attached with the diaphragm and having a discharge valve, and a slide shaft for causing said diaphragm to reciprocatingly move through the movable plate, wherein a rubber sheet is provided to be closely in contact with the diaphragm integrally attached to the movable plate when the movable plate reaches the upper dead point so that fluid does not remain in a space formed between the diaphragm and the rubber sheet.

2 Claims, 3 Drawing Figures

FIGURE 1 *PRIOR ART*

DIAPHRAGM TYPE PUMP DEVICE

BACKGROUND OF THE INVENTION

The present invention relates to an improved diaphragm type pump device which performs pumping function by the reciprocating movement of a diaphragm through a slide shaft.

FIG. 1 is a longitudinal cross-sectional view of a conventional diaphragm type pump device of this kind. In FIG. 1, a slide shaft 1 is supported by a slide bearing 14 mounted on a predetermined position of a bracket 2 to be capable of reciprocating movement. A movable plate 6 is integrally secured to the upper end of the slide shaft 1 by caulking, a flexible diaphragm 5 being secured to the movable plate 6 in an overlapping state by means of, for example, heat-bonding. A plurality of discharge valves 8, 8 are mounted on the movable plate 6. The circumferential part of the diaphragm 5 is clamped by the casing 3 connected to the bracket 2 and a cover 4 closing an opening of the casing 3, whereby the interior of the casing 3 provided with the cover 4 is sealingly partitioned into a suction chamber A and a discharge chamber B. A valve sheet 10 provided with an inlet valve 9 at its central portion is mounted at the base portion of an inlet tube 4*a* which is formed at the substantially central portion of the cover 4. An O-ring 15 is placed in an annular groove in the outer circumferential surface of the valve sheet 10 to keep air tightness of a fitting surface formed between the valve sheet 10 and the cover 4. A coil spring 11 extends between a spring receptacle 12 held at a predetermined position of the slide shaft 1 by means of a snap ring 13 and the lower surface of the casing 3, thereby to urge the slide shaft 1 in the downward direction. A fixing bolt 16 is provided to fix the bracket 2 and the casing 3 together.

In the conventional diaphragm type pump device having the construction as above-mentioned, when the movable plate 6 is lowered from the upper dead point as shown in FIG. 1 by a returning elastic force of the coil spring 11, the suction chamber A is rendered to be in a negative pressure condition whereby the inlet valve 9 is opened and accordingly, fluid is sucked from the inlet valve 9 into the suction chamber A. When the movable plate 6 is lowered to a predetermined position, namely the lower dead point and the movable plate 6 is raised along with the slide shaft 1 by means of, for example, a cam mechanism (not shown) against the action of the coil spring 11, pressure in the suction chamber 1 increases to close the inlet valve 9 which has been opened. Conversely, the discharge valves 8, 8 of the movable plate 6 are opened whereby the fluid inside the suction chamber A is discharged into the discharge chamber B through the discharge valves 8, 8. In the next place, the movable plate 6 is again lowered from the upper dead point as shown in FIG. 1 by the returning elastic force of the coil spring 11. Then, the discharge valves 8, 8 of the movable plate 6 which have been opened are closed and the fluid inside the discharge chamber B is discharged outside through a discharge hole 3*a* and at the same time, the fluid is sucked into the suction chamber A through the inlet valve 9. By repeating the operations as above-mentioned, the fluid is sucked through the inlet tube 4*a* and is discharged outside through the discharge hole 3*a*.

Since the conventional diaphragm type pump device is constructed as above-mentioned, the fluid always remains in an air gap G formed between the diaphragm 5 and the cover 4 even when the movable plate 6 reaches the upper dead point as shown in FIG. 1, on account of which efficiency of the pump device is poor. Particularly, when the diaphragm type pump device is used as a vacuum pump, an achievable degree of vacuum is low and especially, the rising characteristic of vacuum is poor.

SUMMARY OF THE INVENTION

It is an object of the present invention is to eliminate the disadvantage of the conventional pump device and to provide a diaphragm type pump device to improve pump efficiency by constructing it in such a manner that when a movable plate reaches the upper dead point, fluid does not remain in a suction chamber.

The foregoing and the other objects of the present invention have been attained by providing a diaphragm type pump device comprising a casing having a cover in which an inlet valve is installed, a diaphragm dividing the interior of the casing into a suction chamber and a discharge chamber, a movable plate attached with the diaphragm and having a discharge valve, and a slide shaft for causing the diaphragm to reciprocatingly move through the movable plate, characterized in that a rubber sheet is provided to be closely in contact with the diaphragm integrally attached to the movable plate when the movable plate reaches the upper dead point so that fluid does not remain in a space formed between the diaphragm and the rubber sheet.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 1:
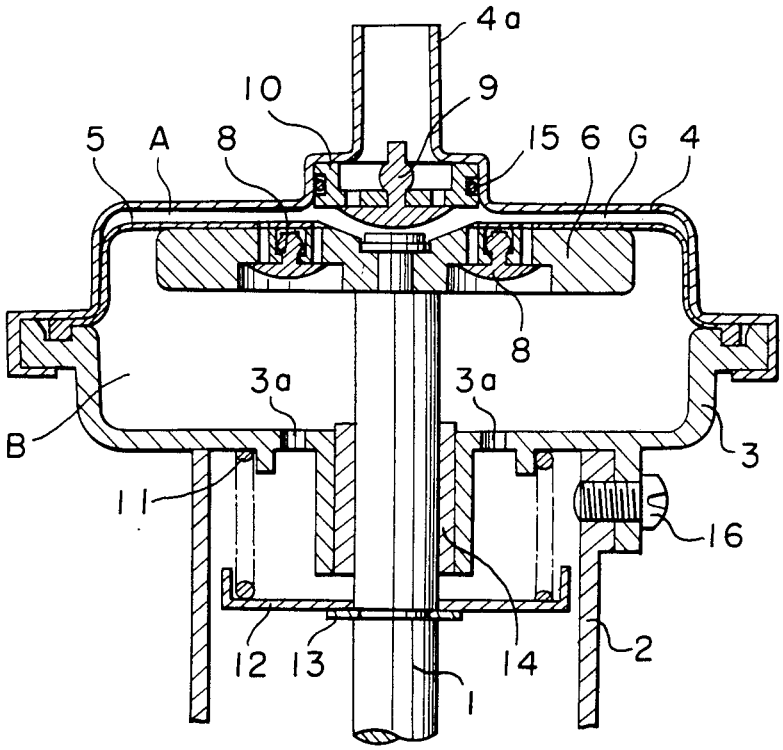
FIG. 1 is a longitudinal cross-sectional view of a conventional diaphragm type pump device.
Figure 2:
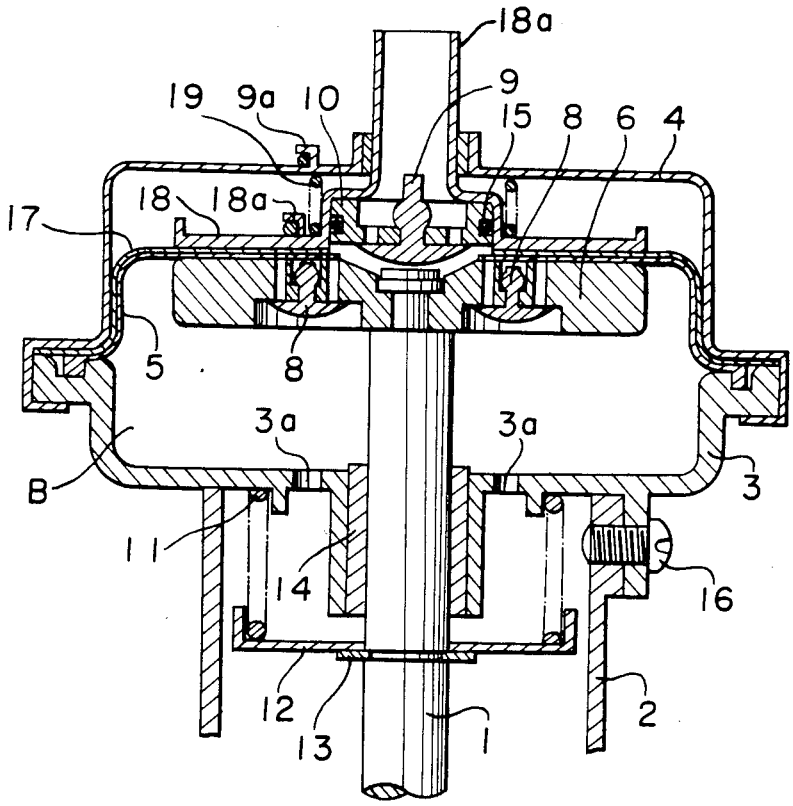
FIG. 2 is a longitudinal cross-sectional view of an embodiment of the diaphragm type pump device according to the present invention.

Preferred embodiments of the diaphragm type pump device of the present invention will be described with reference to the drawings. FIG. 2 is an embodiment of the present invention in which the same reference numerals as in FIG. 1 designate the same or corresponding parts and description of these parts is therefore omitted. In FIG. 2, a head plate 18 which is movable independently of the movable plate is placed inside the cover 4. The head plate 18 is provided at its substantially central part an inlet tube 18*a* at the base portion of which a valve sheet 10 having an inlet valve 9 is fitted. Between the head plate 18 and the cover 4, a coil spring 19 for absorbing shock extends. One end of the coil spring 19 is engaged with an engaging part 18*a* formed in the head plate 18 and the other end is engaged with an engaging part 9*a* formed in the cover 4. The head plate 18 is movably fitted to the cover 4. A rubber sheet 17 is attached in a overlapping state to the bottom surface of the head plate 18 by means of, for example, heat bonding. The circumferential part of the rubber sheet 17 is clamped along with the diaphragm 5 by the casing 3 and the cover 4 closing an opening of the casing 3. The rubber sheet 17 is constructed in such a manner that when the movable plate 6 is raised to the upper dead point corresponding to a minimum suction chamber size position, the diaphragm 5 integrally attached to the movable plate 6 comes in close-contact with the rubber sheet 17 as shown in FIG. 2 so as not to form an air space between the diaphragm 5 and the rubber sheet 17, hence fluid does not remain in the air gap.

In the diaphragm type pump device of this embodiment constructed as above-mentioned, when the movable plate 6 reaches the upper dead point as shown in FIG. 2, the diaphragm 5 integrally attached to the movable plate 6 comes in close-contact with the rubber sheet 17 to prevent formation of an air gap. Accordingly, there is no risk of residual fluid inside the suction chamber A. Further, since the coil spring 19 for absorbing shock is provided between the head plate 18 integrally attached to the rubber sheet 17 and the cover 4, there may be caused no damage even though a shock is imparted to the rubber sheet 17 to some extent by the diaphragm 5 along with the movable plate 6.

Figure 3:
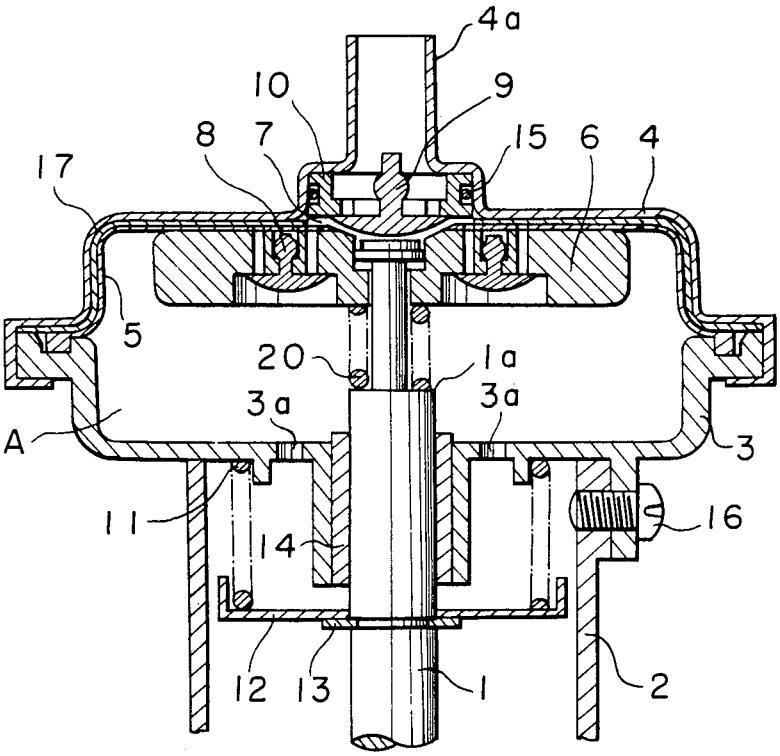
FIG. 3 is a longitudinal cross-sectional view of another embodiment of the present invention.

FIG. 3 shows another embodiment of the present invention. In this embodiment, the rubber sheet 17 is firmly attached in an overlapping state to the inner surface of the cover 4 and the movable plate 6 is secured to the slide shaft 1 in a movable manner. In addition, an coil spring 20 for absorbing shock is interposed between the a stepped portion 1*a* formed in the slide shaft 1 and the movable plate 6. With the construction of this embodiment, when the movable plate 6 reaches the upper dead point, the diaphragm 5 and the rubber sheet 17 comes in close-contact with each other whereby formation of an air gap is prevented and accordingly, there is no residual fluid in the suction chamber A. The function and effect attained by this embodiment are the same as in the first embodiment.

As described above, in accordance with the present invention, when the movable plate 6 reaches the upper dead point, the diaphragm 5 integrally attached to the movable plate 6 comes in close-contact with the rubber sheet 17 to prevent formation of an air gap between the diaphragm 5 and the rubber sheet 17. Accordingly, reduction in efficiency in the pump device due to residual fluid in the air gap is prevented. Particularly, an achievable degree of vacuum in case it is used as a vacuum pump is extremely high and the rising characteristic of vacuum is improved.

Obviously, numerous modifications and variations of the present invention are possible in light of the above teachings. It is therefore to be understood that within the scope of the appended claims, the invention may be practiced otherwise than as specifically described herein.

I claim:

1. A diaphragm type pump device comprising:

a casing having a cover;

a diaphragm dividing an interior of said casing into a suction chamber and a discharge chamber;

a movable plate fixed to said diaphragm and having a discharge valve communicating said suction and discharge chambers;

a slide shaft fixed to said movable plate for reciprocating said movable plate and said diaphragm, whereby said diaphragm can move to a minimum suction chamber size position;

a head plate movable positioned in said suction chamber independently of said movable plate, and including an inlet valve; and a rubber sheet in and defining a portion of said suction chamber, said rubber sheet having a circumferential part clamped by said casing and said cover and a central part fixed to said head plate, wherein said rubber sheet is shaped so as to come in close surface contact with said diaphragm when said diaphragm moves to said minimum suction chamber size position, whereby fluid does not remain between said diaphragm and said rubber sheet.

2. The diaphragm type pump device according to claim 1 wherein a coil spring for absorbing shock extends between said head plate and said cover.

* * * * *